United States Patent [19]

Heller

[11] 3,973,371

[45] Aug. 10, 1976

[54] FURNITURE AND WALL STRUCTURAL SYSTEM

[76] Inventor: Stephen M. Heller, 2300 Bridgeway, Sausalito, Calif. 94965

[22] Filed: Sept. 12, 1975

[21] Appl. No.: 612,836

Related U.S. Application Data

[63] Continuation-in-part of Ser. No. 516,539, Oct. 21, 1974, abandoned.

[52] U.S. Cl. ..... 52/758 H; 52/280; 52/461; 52/656; 52/731; 312/257 R; 403/171; 403/172; 403/295

[51] Int. Cl.[2] ..... E04C 3/04; E04B 1/58

[58] Field of Search ..... 52/280, 476, 501, 656, 52/758 H, 461, 731; 312/111, 140, 257 R, 263; 403/171, 172, 295

[56] References Cited

UNITED STATES PATENTS

| | | | |
|---|---|---|---|
| 3,063,524 | 11/1962 | Kessler | 52/476 |
| 3,087,768 | 4/1963 | Anderson et al. | 52/758 H X |
| 3,272,582 | 9/1966 | Anderson et al. | 52/758 H X |
| 3,485,519 | 12/1969 | Chiu | 52/758 H |
| 3,736,035 | 5/1973 | Brown | 52/758 H |
| 3,784,043 | 1/1974 | Presnick | 52/758 H X |

FOREIGN PATENTS OR APPLICATIONS

| | | | |
|---|---|---|---|
| 632,445 | 7/1962 | Italy | 52/501 |

*Primary Examiner*—Alfred C. Perham
*Attorney, Agent, or Firm*—Townsend and Townsend

[57] ABSTRACT

Apparatus is disclosed for constructing a skeletal framework adapted to support wall, furniture or other structural panels. The apparatus includes a plurality of elongate channel members each having a generally rectangular cross section, one side of which defines an axial slot. A plurality of generally flat elongate cover plates are also provided, each having elongate tongue means extending lengthwise along the cover plate and adapted to engage the slot in one of the channel members. The cover plates and channel members each have flanges at their outer edges so that when joined together to form a skeletal frame member, they define a plurality of exposed recesses. A plurality of spline members are provided to interconnect the joined cover plates and channel members at their ends. Each spline member has a generally cubical block portion and at least two orthogonal extensions adapted to project into the ends of adjacent channel members. The extensions include transverse ridges adapted to fit within notches in the tongue means of the cover plates engaged with the channel members to lock the combined cover plate and channel members together into a structural framework. The recesses provided by the structural framework support structural panels to provide an interior wall or furniture piece.

9 Claims, 11 Drawing Figures

FURNITURE AND WALL STRUCTURAL SYSTEM

This application is a continuation-in-part of my copending patent application for FURNITURE AND WALL STRUCTURAL SYSTEM, filed Oct. 21, 1974, Serial No. 516,539 and now abandoned.

BACKGROUND OF THE INVENTION

The present invention relates to structural systems, and in particular to apparatus for constructing a skeletal framework designed to support wall, furniture, or other structural panels.

A wide variety of various structural systems have been developed to support structural panels for the construction of either walls or furniture pieces. Some such structural systems are intended to be permanent, while others can be disassembled easily and can be used for temporary structures. However, each of these two types of structural systems are a difficult compromise between the aesthetic appeal of the system and the rigidity necessary to provide a usable structure. Some such structural systems employ a large number of bolts and other connecting elements which provide the necessary rigidity but are aesthetically unappealing. In others the rigidity of the structure is sacrificed for appearance. In still others rigidity is maintained with an aesthetically appealing structure only by the use of various covering members over the basic structural system, and thus the structure is quite complex.

The primary difficulty in achieving an acceptably rigid structure is found at the junction between the various members comprising the skeletal framework of the structure. In most structural systems the members themselves are unitary, and must be bolted or otherwise joined together at their ends to form the desired framework. Some systems have been developed to provide a sufficiently rigid junction between structural members, but in each case this junction is quite complex, being both difficult to manufacture and difficult to install.

SUMMARY OF THE INVENTION

Apparatus is disclosed for constructing a skeletal framework adapted to support wall, furniture or other structural panels. The apparatus includes a plurality of elongate channel members each having a generally rectangular cross section, one side of which defines an axial slot. A plurality of generally flat elongate cover plates are also provided, each having elongate tongue means extending lengthwise along the cover plate and adapted to engage the slot in one of the channel members. The cover plates and channel members each have flanges at their outer edges so that when joined together to form a skeletal frame member, they define a plurality of exposed recesses. A plurality of spline members are provided to interconnect the joined cover plates and channel members at their ends. Each spline member has a generally cubical block portion and at least two orthogonal extensions adapted to project into the ends of adjacent channel members. The extensions include transverse ridges adapted to fit within notches in the tongue means of the cover plates engaged with the channel members to lock the combined cover plate and channel members together into a structural framework. The recesses provided by the structural framework support structural panels to provide an interior wall or furniture piece.

Each skeletal frame member of the present invention is constructed by joining a cover plate to a channel member. In order to form a structural framework with these frame members, they are joined at their ends by the spline members. The spline members have identical block portions, but the number of extensions extending from the various sides varies depending on the type of junction required. However, in each case the junction is completed by first slipping the channel member over the extension and merely snapping the cover plate into engagement with it. Due to the construction of the spline members and their interaction with both the cover plates and channel members, this junction is sufficiently rigid to satisfy the requirements of a wall or furniture system. Since no bolts or other types of extra fasteners are required, the skeletal framework retains its aesthetic appeal without the use of covering members or other such facades.

The novel features which are believed to be characteristic of the invention, both as to organization and method of operation, together with further objects and advantages thereof will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
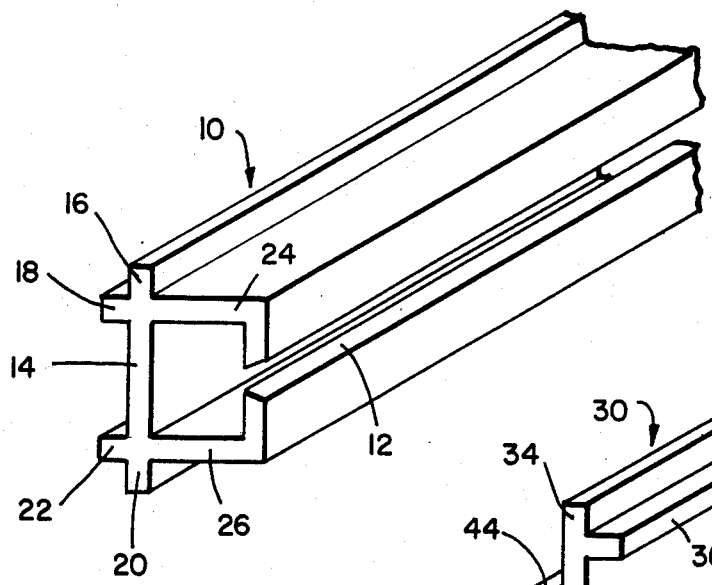
FIG. 1 is a fragmentary perspective view of the channel member of the first embodiment of the present invention.

The basic configuration of the channel member 10 of the first embodiment of the present invention is illustrated by way of reference to FIG. 1. Each channel member 10 has a basically rectangular configuration with a slot 12 formed in the center of one side thereof and running the length of the member. At the opposite side 14 from the side of the member having slot 12, pairs of orthogonal flanges 16, 18 and 20, 22 run the length of the member. Flanges 16, 20 are coplanar with side 14 of channel member 10. Flange 18 is coplanar with side 24 and flange 22 is coplanar with side 26. Channel members 10 used to form a given structure will have identical cross sections although the lengths of the various members may vary or may be cut as desired. For different applications, the cross sectional dimensions of channel members 10 may vary. For example, the transverse dimension of the members may be relatively small for the construction of furniture, and would be relatively larger for walls.

Figure 2:
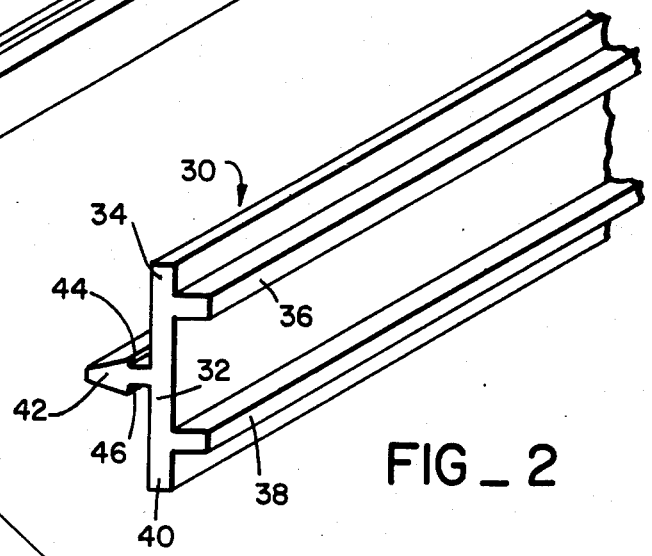
FIG. 2 is a fragmentary perspective view of the cover plate of the first embodiment of the present invention.

The cover plate 30 of the first embodiment of the present invention is illustrated by way of reference to FIG. 2. Cover plate 30 is basically flat, having a flat portion 32 provided with pairs of orthogonal flanges 34, 36 and 38, 40 along either side. One flange of each pair, such as 34 and 40, are coplanar with flat portion 32, and the other flanges 36, 38 are normal thereto and directed in a common direction. An arrow-shaped tongue 42 extends from the opposite side of flat portion 32 and runs along the length of cover plate 30.

Cover plate 30 is adapted to be attached to a channel member 10 by inserting arrow-shaped tongue 42 through slot 12 are tapered as illustrated in FIG. 1 to facilitate insertion of the tongue through the slot. Tongue 42 has depending ridges 44, 46 which are adapted to project completely through slot 12 so that tongue 42 is rigidly engaged with the slot and will not readily be disengaged. No bolts or other fasteners of any kind are required to firmly engage each cover plate 30 to its associated channel member 10.

Figure 3:
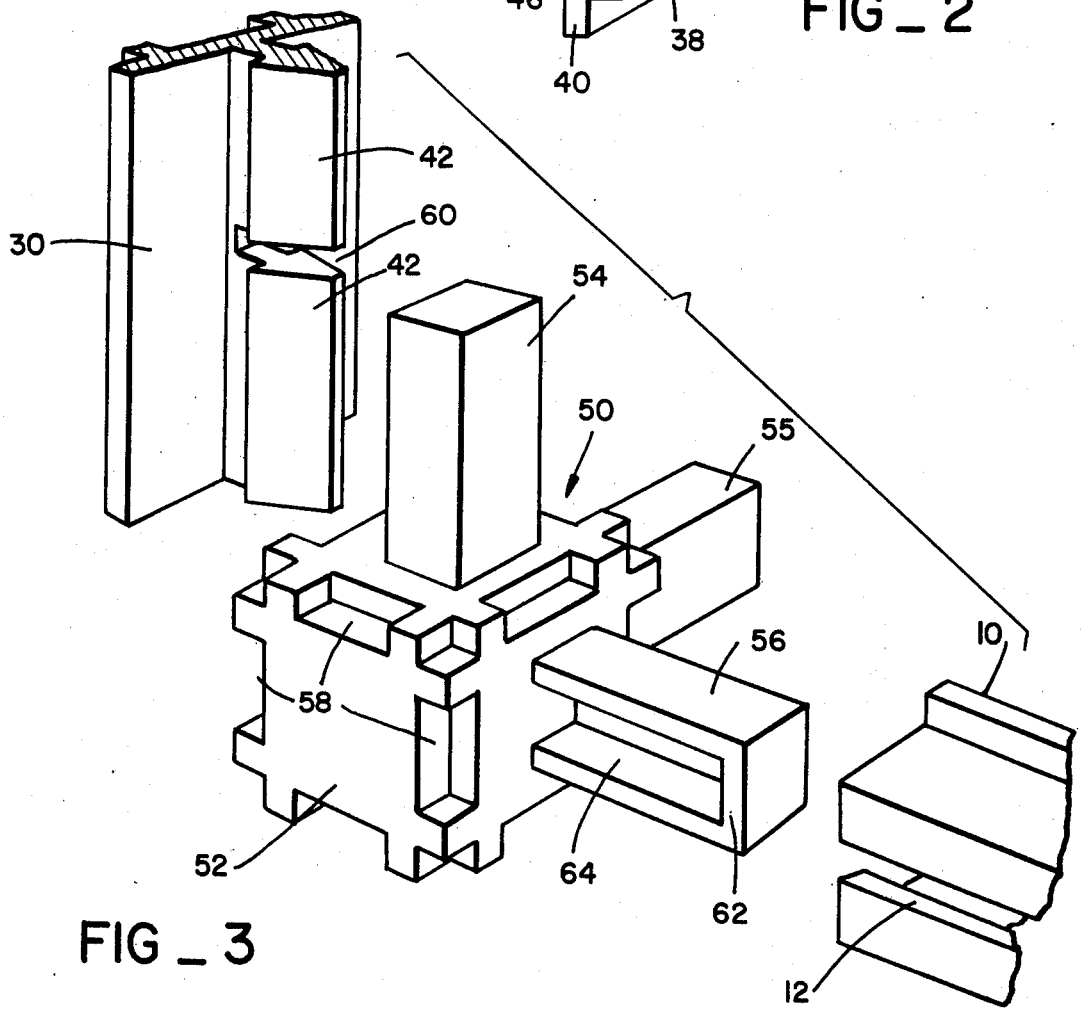
FIG. 3 is a perspective view of one of the spline members of the first embodiment of the present invention.

A typical spline member 50 of the first embodiment of the present invention is illustrated by way of reference to FIG. 3. Each such spline member includes a generally cubical block portion 52 having a plurality of extensions 54–56 extending from various sides thereof. The number and location of such extensions varies depending upon the type of junction required.

Each block portion 52 has recesses such as 58 at the various corners adapted to conform to the recesses which are formed by the combines cover plates and channel members, as will be illustrated hereinafter. Referring still to FIG. 3, each cover plate such as 30 has a notch 60 formed in the tongue adjacent each end of the cover plate. The outer extremity of each extension 54–56 of spline member 50 comprises a transverse ridge 62 corresponding to notch 60. The outer surfaces of each such extension are adapted to conform to the inner surface of each channel member 10, with the exception of a cutout portion 64 adjacent slot 12 to allow for insertion of the tongue 42 of the cover plate. Hence, when a cover plate is slipped over one of the extensions 54–56, the meshing exterior and interior surfaces of the extensions and the cover plate respectively prohibit pivoting movement of the channel member, transverse ridge 62 will mate with notch 60, and the frame member provided by the cover plate and channel member will be rigidly locked to spline member 50.

Figure 4:
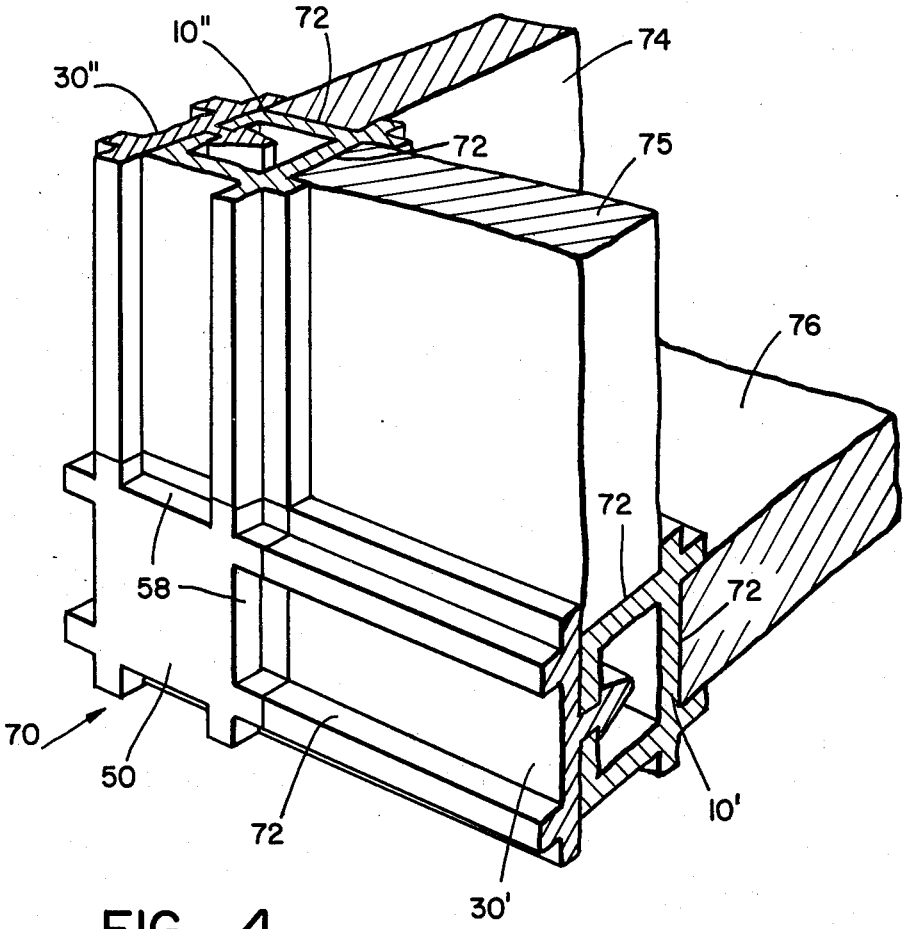
FIG. 4 is a fragmentary perspective view of a junction formed by the first embodiment of the present invention.

A completed junction 70 between skeletal frame members formed according to the teachings of the first embodiment of the present invention is illustrated by way of reference to FIG. 4. In this figure, cover plates 30′, 30″ have been engaged with corresponding channel members 10′, 10″ as illustrated. Furthermore, the frame members provided by the engaged cover plates and channel members are rigidly interconnected by spline member 50. The various flanges on the frame members provide a plurality of recesses 72. Various structural panels 74–76 are adapted to fit in the various recesses 72, providing a finished wall structure or furniture piece. The recesses 58 in the block portion of spline member 50 cooperate with the various recesses 72. The system of the present invention is thus constructed without the use of bolts or other types of fasteners but is still sufficiently rigid to provide a solid wall or furniture construction.

Figure 5:
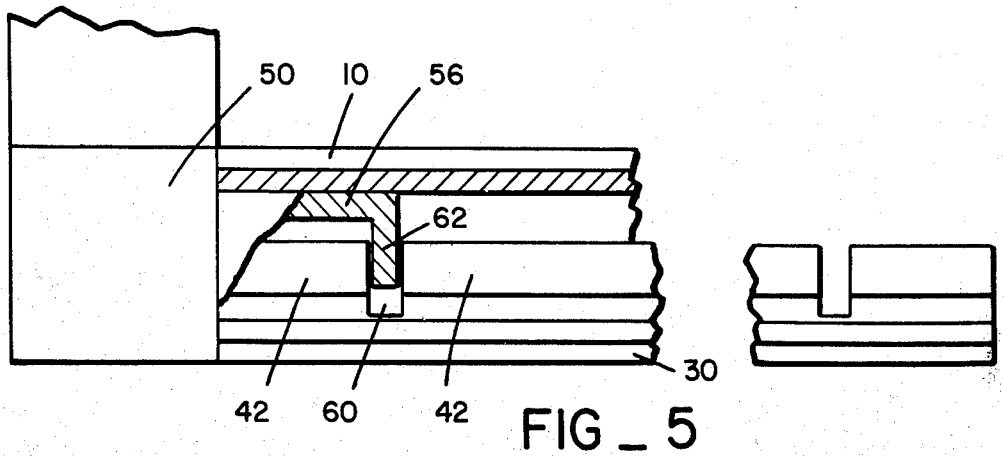
FIG. 5 is a partially broken away view illustrating the locking action of the first embodiment of the present invention.

The interaction of each extension such as 56 of spline member 50 with its attached frame member is further illustrated by way of reference to FIG. 5. It is apparent from this figure that the outer surfaces of the extension are conformed to the inner surfaces of channel member 10 so that pivoting movement of the channel member is prevented. Furthermore, the transverse ridge 62 at the outer extremity of the extension engages notch 60 in tongue 42 so that cover plate 30 cannot move laterally with respect to spline member 50. Since combined cover plate 30 and channel member 10 are rigidly fixed together, any movement of the skeletal frame member formed thereby with respect to spline member 50 is substantially prohibited.

Figure 6:
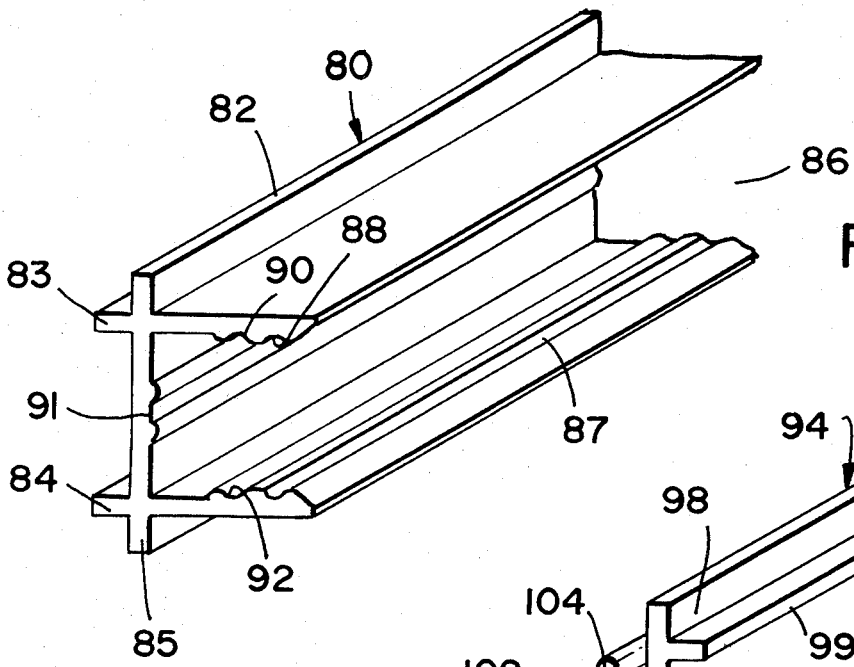
FIGS. 6 and 7 are fragmentary perspective views of the channel member and cover plate of the second embodiment of the present invention.

A channel member 80 constructed according to the teachings of the second embodiment of the present invention is illustrated by way of reference to FIG. 6. Channel member 80 has a generally rectangular configuration, and includes a plurality of outwardly directed flanges 82–85 extending the length of the member. One side 86 of the rectangular configuration is open to define a relatively wide slot which extends the length of the member also. The slot defined by side 86 includes a pair of grooves 87, 88 running along the edge of the slot. In addition, axial grooves 90–92 are provided in the inner sidewalls of channel member 80 and extend the length thereof. Grooves 88, 87 and 90–92 are used to interconnect various members to form a skeletal framework, as illustrated in more detail hereinbelow.

Figure 7:
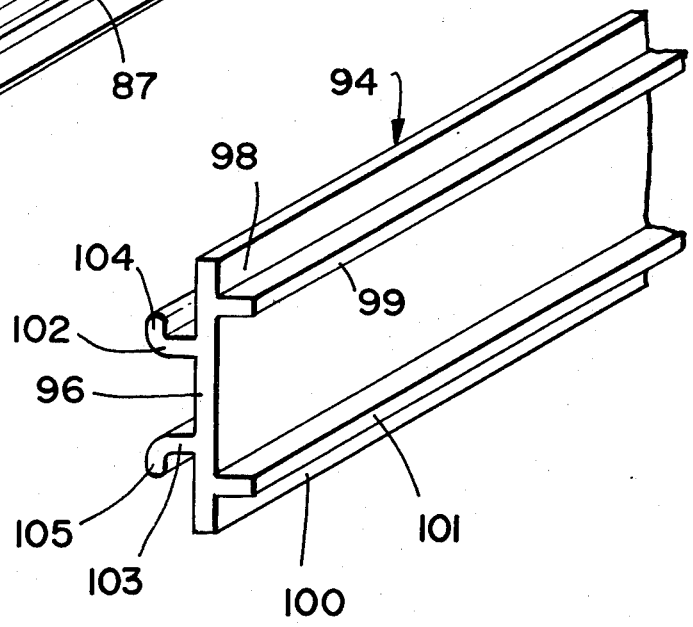

A cover plate 94 of the second embodiment of the present invention is illustrated in FIG. 7. Cover plate 94 includes planar section 96 having pairs of orthogonal flanges 98, 99 and 100, 101 extending from the lateral edges thereof. Cover plate 94 is also provided with tongue means comprising a pair of tongue members 102, 103 extending from planar portion 96 on the opposite side from flanges 99, 101. Each tongue member 102, 103 includes an outwardly directed ridge 104, 105.

In constructing the structural framework using the second embodiment of the present invention, each frame member of the framework is constructed by joining a cover plate such as 94 to a channel member 80. For this purpose, tongue members 102, 103 are inserted through the slot defined by side 86 of channel member 80. Outwardly directed ridges 104, 105 will engage corresponding grooves 88, 87 in channel member 80 to interconnect the plate and the channel member and form a single structural element. Flanges 82–85 on channel member 80 and flanges 98–101 on cover plate 94 combine to provide a plurality of recesses for supporting structural panels as in the first embodiment.

Figure 8:
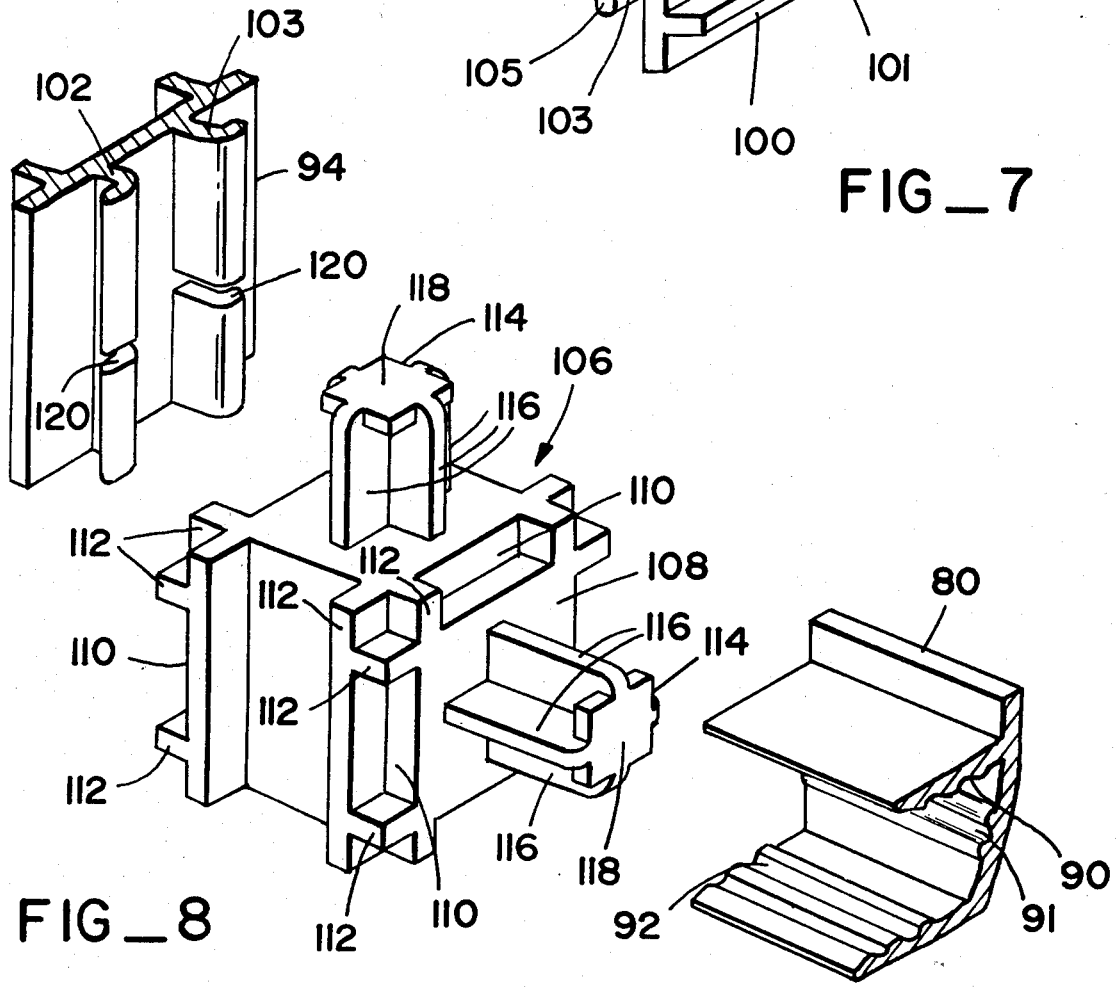
FIG. 8 is a perspective view of one of the spline members of the second embodiment of the present invention.

In order to join together various frame members formed by joining each cover plate 94 to its corresponding channel member 80, spline members such as 106 illustrated in FIG. 8 are used at each end of such frame members. Spline member 106 has a basically cubical portion 108. A plurality of recesses 110 are provided at the edges of cubical portion 108, and are defined by ribs 112. Ribs 112 correspond to the various flanges on the cover plates 94 and channel members 80. As a result, ribs 112 act as an extension of these flanges to extend the recesses for structural panels defined thereby.

Each spline member such as 106 includes a plurality of extensions 114 extending from cubical portion 108. The number and location of extensions 114 will vary for various spline members depending on the type of junction desired. Each extension 114 includes a plurality of ribs 116 terminating in a transverse planar portion 118. Each spline extension 114 is adapted to project into an adjacent frame member formed by a cover plate 94 joined to a channel member 80.

As illustrated in FIG. 8, a notch 120 is formed proximate the end of tongue members 102, 103 on each cover plate 94. Notch 120 corresponds to the planar portion 118 of spline extension 114. As a result, when cover plate 94 is joined to a channel member circumscribing extension 114, planar portion 118 of extension 114 will engage notch 120 of cover plate 94 to prevent axial movement of the cover plate relative to spline member 106.

When a channel member such as 80 engages spline extension 114, ribs 116 on the spline extension will engage grooves 90–92 on the interior surfaces thereof. As a result, rotational movement of channel member 80 relative to spline member 106 will be prevented. The engagement of the cover plate and the channel member together and to the spline extension thus locks the frame member formed by the cover plate and channel member to the spline member.

Figure 9:
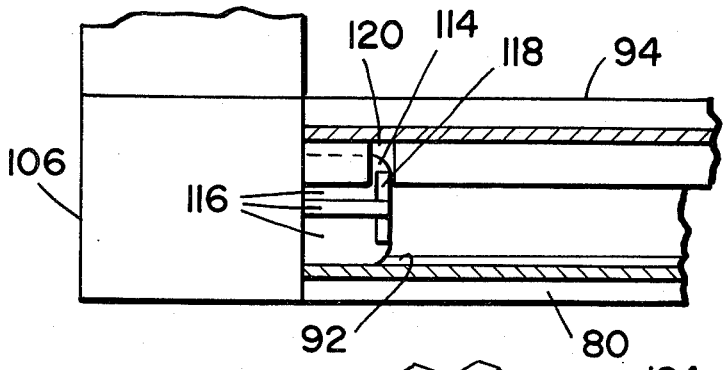
FIG. 9 is a fragmentary broken away view of the locking action of the second embodiment.

The manner in which a joined cover plate 94 and channel member 80 are locked to the spline extension 114 of spline member 106 when joined thereto is illustrated in more detail by way of reference to FIG. 9. The planar portion 118 of extension 114 fits into notch 120 in cover plate 94. The ribs 116 of extension 114 fit into grooves such as 92 in channel member 80. As a result, the frame member formed by the interconnected cover plate 94 and channel member 80 is rigidly locked to spline member 106.

Figure 10:
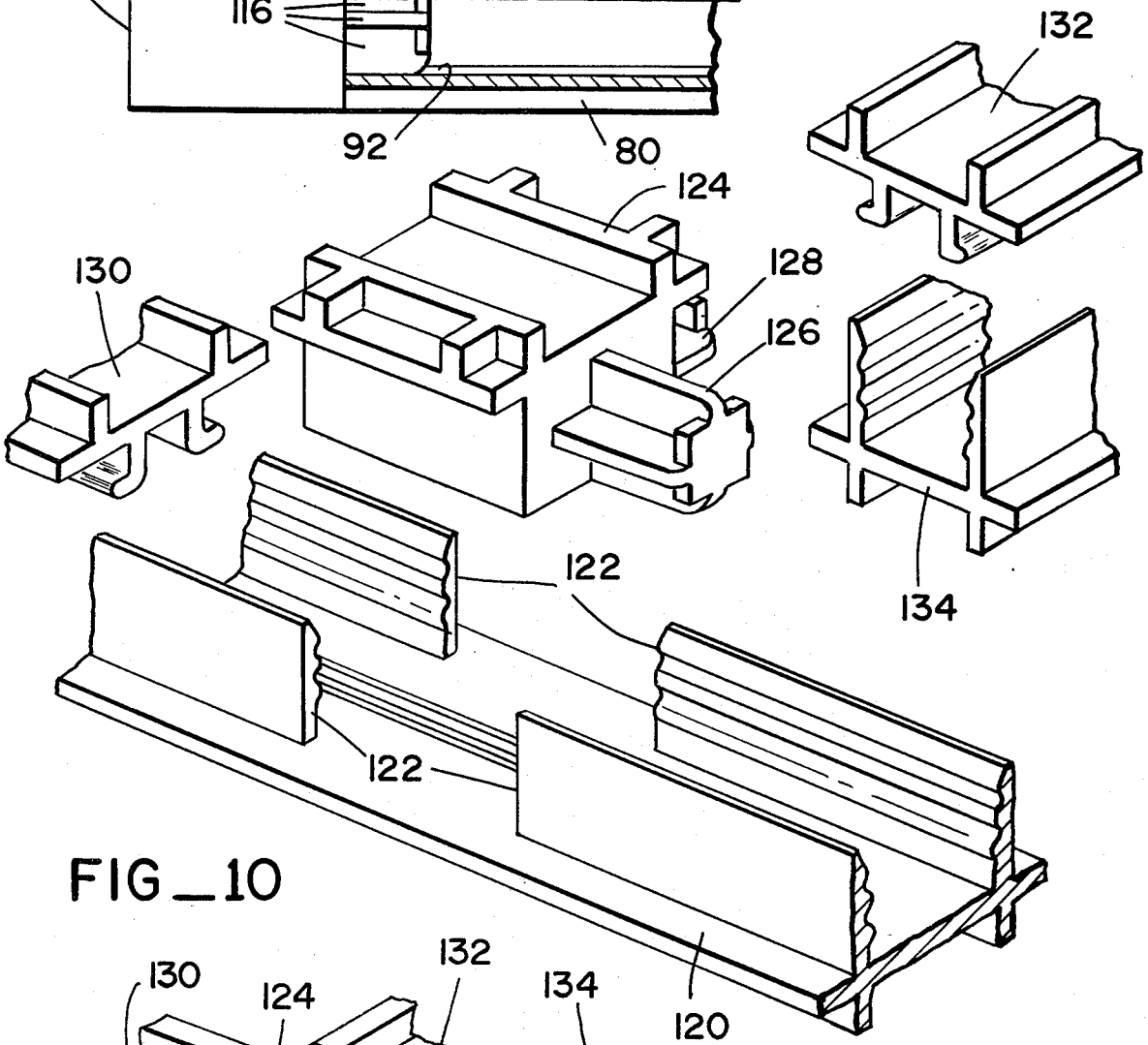
FIG. 10 is an exploded view of a type of junction formed with the second embodiment.
Figure 11:
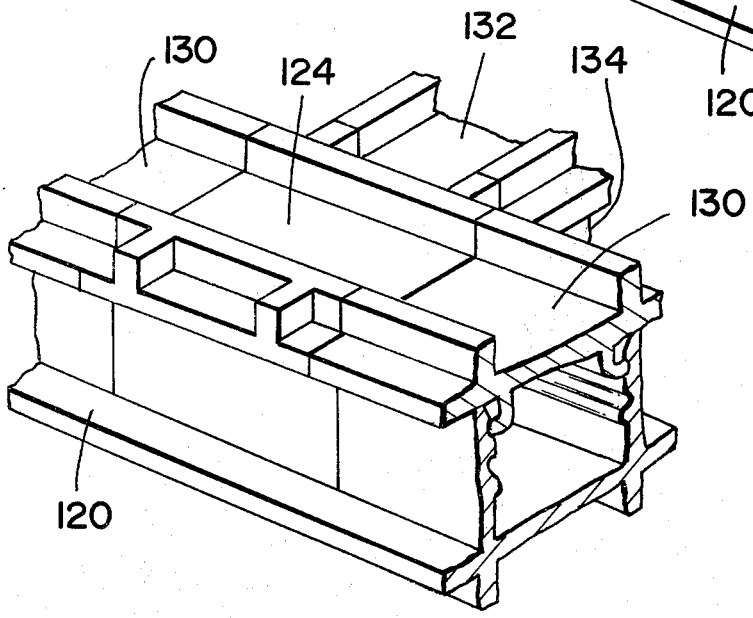
FIG. 11 is a perspective view of the junction of FIG. 10.

An alternate form of a junction provided by the second embodiment of the present invention is illustrated by way of reference to FIGS. 10 and 11 in combination. A channel member 120 is provided which has a transverse cutout portion 122. A spline member 124 is provided having a pair of oppositely disposed extensions such as 126 projecting in opposite directions into the interior of channel member 120. Spline member 124 also includes one or more spline extensions such as 128 which extend transversely with respect to channel member 120.

A pair of cover plates such as 130 (only one cover plate is shown in FIG. 10 for clarity) engage channel member 120 on the opposite sides of spline member 124. As previously described, cover plates 130 engage the extensions 126 of spline member 124 when joined to the opposite sides of channel member 120 to rigidly interconnect the frame member formed thereby to the spline member.

An additional frame member is formed by joining a cover plate 132 to a corresponding channel member 134. Cover plate 134 is adapted to circumscribe spline extension 128, and is locked thereto when joined to cover plate 132. As a result, a frame member is provided by members 132, 134 which extend transversely from the frame member provided by members 120, 130.

A skeletal framework for a wall structure or furniture piece can easily be constructed with the apparatus of either the first or the second embodiments of the present invention. A plurality of generally identical channel members 10 (or 80) and cover plates 30 (or 94) are provided along with a variety of different types of spline members 50 (or 106). The framework is constructed by selecting the spline member appropriate for each corner or junction, slipping channel members 10 (or 80) over the various extensions of the spline member, and snapping cover plates 30 (or 94) into engagement with the channel members. Various specialized joints such as that depicted in FIGS. 10 and 11 can also be devised. As the structural framework is being formed, structural panels can be placed in recesses provided by the structural framework to complete the item.

While preferred embodiments of the present invention have been illustrated in detail, it is apparent that modifications and adaptations of those embodiments will occur to those skilled in the art. However, it is to be expressly understood that such modifications and adaptations are within the spirit and scope of the present invention as set forth in the following claims.

What is claimed as new is:

1. Apparatus for constructing a skeletal framework adapted to support wall, furniture or other structural panels, said apparatus comprising:

a plurality of elongate channel members each having a generally rectangular cross section, one side of each of the channel members defining axial slot means extending the length thereof;

a plurality of generally flat elongate cover plates each having elongate, ridged tongue means extending from one side thereof along the length of the cover plate and projecting through the slot means in one of the channel members engaging and latching the channel member with the cover plate to provide a skeletal frame member, said tongue means each having a notch adjacent each end thereof;

said cover plates and said channel members each having flanges at the edges thereof, said flanges cooperating to define a plurality of recesses on selected sides of the skeletal frame member formed therewith; and a plurality of spline members each having a generally cubical block portion and at least two orthogonal extensions from the block portion each projecting inside one end of a channel member, said extensions including transverse ridges fitting within the notches in the tongue means of cover plates engaged with the respective channel members to lock the frame members formed thereby into a skeletal framework having a plurality of recesses for supporting the structural panels.

2. Apparatus as recited in claim 1 wherein the axial slot means comprises a relatively narrow slot extending the length of each elongate channel member, and wherein the tongue means comprises a unitary projection extending from one side of each elongate cover plate and adapted to engage the slot means.

3. Apparatus as recited in claim 1 wherein the axial slot means extends transversely across substantially the entire width of the rectangular cross section of each said channel member, and wherein the tongue means comprises a pair of ridged tongue members extending from one side of each cover plate and adapted to engage the slot means.

4. Apparatus for constructing a skeletal framework adapted to support wall, furniture or other structural panels, said apparatus comprising:

a plurality of elongate channel members each having a generally rectangular cross section, one side of each of the channel members defining axial slot means extending the length thereof and the other opposite side having a pair of orthogonal flanges extending from each edge thereof, said flanges being coplanar with the sides of the channel member forming the associated edge;

a plurality of generally flat elongate cover plates each having elongate, ridged tongue means extending from one side thereof along the length of the cover plate and projecting through the slot in one of the channel members engaging and latching the channel member with the cover plate, said tongue means each having a notch adjacent each end thereof, said cover plates each having a pair of orthogonal flanges extending from each edge thereof, one flange of each pair being coplanar with the cover plate and the other flange of each pair directed opposite from the tongue means so that each engaged cover plate and channel member in combination provide a skeletal frame member having four orthogonal recesses on the respective sides of the frame member defined by adjacent pairs of flanges; and a plurality of spline members each having a generally cubical block portion and at least two orthogonal extensions from the block portion each projecting inside one end of a channel member, said extensions including transverse ridges fitting within the notches in the tongue means of cover plates engaged with the respective channel members to lock the frame members formed thereby into a skeletal framework having a plurality of recesses for supporting the structural panels.

5. Apparatus as recited in claim 4 wherein the axial slot means comprises a relatively narrow slot extending the length of each elongate channel member, and wherein the tongue means comprises a unitary projection extending from one side of each elongate cover plate and adapted to engage the slot means.

6. Apparatus as recited in claim 4 wherein the axial slot means extends transversely across substantially the entire width of the rectangular cross section of each said channel member, and wherein the tongue means comprises a pair of ridged tongue members extending from one side of each cover plate and adapted to engage the slot means.

7. Apparatus as recited in claim 5 wherein the tongues of the cover plates are arrow-shaped so that the head portion of the arrow-shaped tongue projects totally through the slot in the engaged channel member to rigidly lock the cover plates to the respective channel members.

8. Apparatus as recited in claim 4 wherein the outer surfaces of the extensions are conformed to the inner surfaces of the channel member except adjacent the slot in the channel member to minimize movement of the frame member with respect to the associated spline member.

9. Apparatus as recited in claim 4 wherein the interior surfaces of the channel members include a plurality of grooves, and wherein the extensions include a plurality of ribs engaging said grooves to minimize movement of the frame member with respect to the associated spline member.

* * * * *